US007051954B2

(12) United States Patent
Gerstner

(10) Patent No.: US 7,051,954 B2
(45) Date of Patent: May 30, 2006

(54) EXTERNAL MIXING NOZZLE

(75) Inventor: Stefan Gerstner, Lichtenfels (DE)

(73) Assignee: Dusen-Schlick GmbH, Untersiemau/Coburg (DE)

( * ) Notice: Subject to any disclaimer, the term of this patent is extended or adjusted under 35 U.S.C. 154(b) by 85 days.

(21) Appl. No.: 10/275,250

(22) PCT Filed: Feb. 28, 2002

(86) PCT No.: PCT/EP02/02199

§ 371 (c)(1),
(2), (4) Date: Aug. 27, 2003

(87) PCT Pub. No.: WO02/074446

PCT Pub. Date: Sep. 26, 2002

(65) Prior Publication Data

US 2004/0035952 A1 Feb. 26, 2004

(30) Foreign Application Priority Data

Mar. 15, 2001 (DE) ..... 101 12 562

(51) Int. Cl.
*A62C 5/00* (2006.01)
*B05B 7/06* (2006.01)

(52) U.S. Cl. ..... 239/398; 239/296; 239/418; 239/424

(58) Field of Classification Search ..... 239/290, 239/296, 298, 423, 424, 433, 583, 398, 418
See application file for complete search history.

(56) References Cited

U.S. PATENT DOCUMENTS 5,209,405 A * 5/1993 Robinson et al. ..... 239/296
5,964,418 A * 10/1999 Scarpa et al. ..... 239/424
5,979,787 A * 11/1999 Scarpa ..... 239/9

FOREIGN PATENT DOCUMENTS

DE 37 09 543 C2 6/1988
GB 2 147 830 A 5/1985

* cited by examiner

*Primary Examiner*—David A. Scherbel
*Assistant Examiner*—Seth Barney
(74) *Attorney, Agent, or Firm*—Sughrue Mion, PLLC

(57) ABSTRACT

An external mixing nozzle, with a flat-jet cap which is fastened to a nozzle body, the flat-jet cap being provided with a central bore or the like, pointing towards the nozzle body, for receiving a liquid insert, and having a central orifice which receives a mouth attachment of the liquid insert, at the same time defining an annular gap surrounding the mouth attachment, the flat-jet cap defining a planar surface portion which runs perpendicularly to the axis of the nozzle body and within which a central orifice is provided, and, furthermore, the surface portion having adjoining it laterally two surfaces running essentially mirror-symmetrically and obliquely to the axis of the nozzle body and adjoining the surface portion, wherein the flat-jet cap contains, in the region of the surface portion, outlet orifices which are provided at an equal distance from the central orifice and which communicate with bores provided so as to run in the jet cap obliquely to the axis of the nozzle body, with transitions from the surface portion to the lateral surfaces being defined by smooth transitions or roundings.

10 Claims, 2 Drawing Sheets

EXTERNAL MIXING NOZZLE

Figure 1:
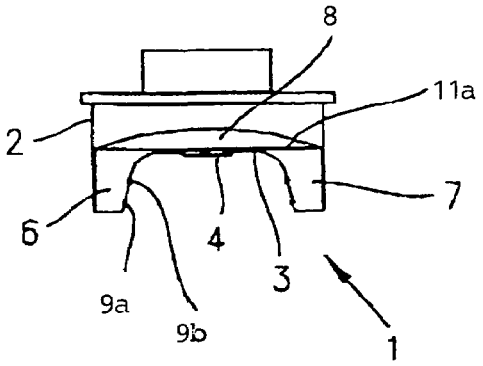
Fig.1 PRIOR ART

The invention relates to an external mixing nozzle according to the preamble of patent claim 1.

External mixing nozzles are used, in particular, for the coating of pharmaceutical products, such as tablets, with colorant. In this context, the pharmaceutical products are located in a rotatably arranged drum (coating drum), while the external mixing nozzles are arranged on an axis parallel to the drum axis, in order to atomize the colorant material vertically within the drum. By means of the colorant mist and the products moved as a result of the drum rotation, the latter are coated with the colorant. The external mixing nozzles used for this purpose consist of a nozzle body, to which a flat-jet cap is fastened. The flat-jet cap is provided with an essentially planar surface portion which has a receiving orifice centrally for the reception of the mouth attachment of a liquid insert, this central orifice defining an annular gap which surrounds the mouth attachment and acts as an air nozzle. On both sides of the flat surface portion are located horns which project approximately perpendicularly from the surface portion and which are in each case provided with bores running obliquely to the axis of the nozzle. These horns located diametrically opposite one another thus contain air nozzles which run obliquely to the axis of the nozzle and bring about a flattening of the colorant jet or liquid jet which is generated by the liquid emerging from the mouth attachment and atomized by means of the annular gap.

In this known external mixing nozzle, the horns are designed to widen conically away from the jet cap on their surface directed toward the central orifice. The jet cap is beveled laterally in relation to the surface portion, edges being formed between the surface portion and the bevel.

One disadvantage of these external mixing nozzles is that, on the one hand, because of the comparatively long distance between the outlet orifices of the air nozzles formed in the horns and the central orifice of the jet cap and as a result of the edges and horns located on the jet cap, colorant deposits and whisker formations occur on the surface of the flat-jet cap and, in the course of time, may impair the spray effect or the quality of the colorant coating or even prevent the spray effect.

The object of the invention is based, therefore, on improving an external mixing nozzle according to the preamble of patent claim 1, in such a way that ink deposits or whisker formation on the flat-jet cap can be largely prevented.

This object is achieved, according to the invention, by means of the features specified in the defining part of claim 1.

Further refinements of the invention may be gathered from the subclaims.

The invention provides, in particular, an external mixing nozzle with a flat-jet cap, in which the flat-jet cap has a central orifice for the mouth attachment of the liquid insert, the central orifice being arranged in an essentially planar surface portion without horns, which runs transversely to the nozzle axis and has adjoining it laterally surfaces which are provided both symmetrically and at a high inclination to the nozzle axis, the transitional regions between the surface portion and the lateral surfaces being rounded off in order to avoid edges. Air outlet orifices lying mirror-symmetrically to the nozzle axis and within the planar surface region are provided laterally in relation to the central orifice, said air outlet orifices being arranged at a comparatively short distance from the central orifice and issuing in bores running obliquely to the nozzle axis.

According to the invention, deposits of liquid or colorant on the flat-steel cap are avoided, i.e. a coating on the flat-steel cap and/or whisker formation on the horns, originating in each case from the liquid substances, is ruled out or at least largely avoided.

Figure 2:
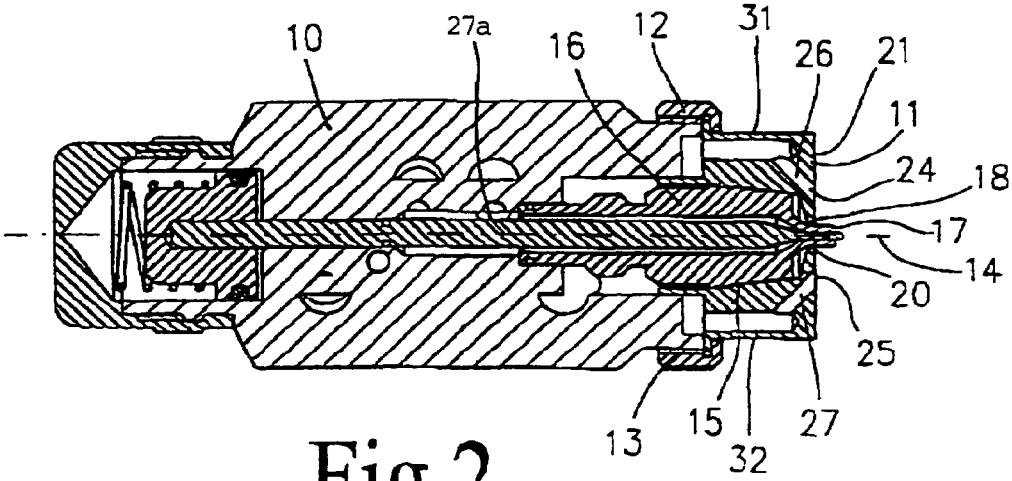
Figure 3:
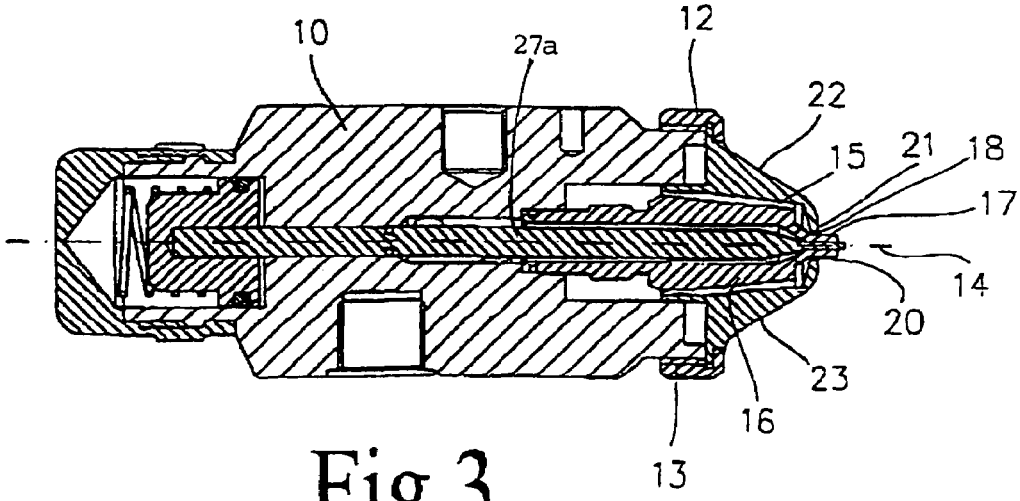
Figure 4:
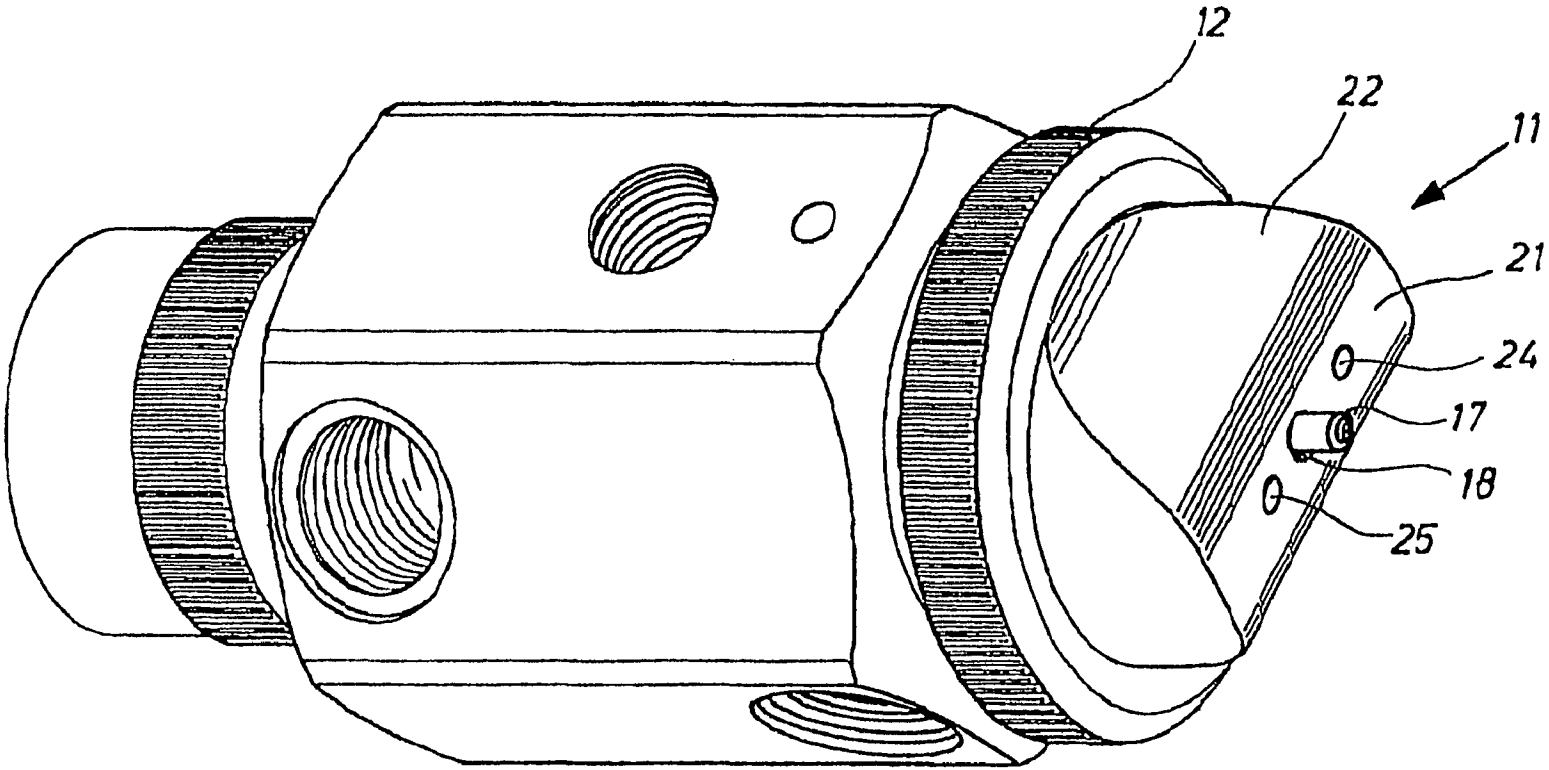

A preferred embodiment of the external mixing nozzle according to the invention is described below, with reference to the drawing, in order to explain further features and advantages. In the drawing:

FIG. 1 shows a side view of a known flat-jet cap of an external mixing nozzle, FIG. 2 shows a sectional view through the external mixing nozzle according to the invention, FIG. 3 shows a further sectional view of the external mixing nozzle, the illustration according to FIG. 3 being rotated through 90° with respect to FIG. 2, and FIG. 4 shows a perspective view of the external mixing nozzle according to the invention.

According to FIG. 1, the known external mixing nozzle has a flat-jet cap 1 consisting of an essentially cylindrical basic body 2 which has, in its direction pointing outward, i.e. in the spray direction, a surface 3 which runs transversely to the nozzle axis and which is provided with a central orifice 4 for receiving the mouth attachment of a liquid insert, not shown. Located laterally in relation to the central orifice 3 are horns 6, 7 which in each case contain two air outlet orifices 9, 10, in such a way that the air flow emerging from these orifices 9, 10 is inclined with respect to the nozzle axis. The planar or straight surface portion 3 is connected via edges 11 to lateral surfaces 12 running obliquely with respect to the nozzle axis. These surfaces 12 are beveled only slightly with respect to a plane which is perpendicular to the nozzle axis. The horns 6, 7 project above the surface portion 3. As may also be gathered, those surfaces of the horns 6, 7 which receive the orifices 9, 10 are designed to widen conically outward in the direction of the nozzle axis.

FIG. 2 shows a sectional view through the external mixing nozzle according to the invention. The external mixing nozzle has a nozzle body 10, to which a flat-jet cap 11 is fastened. The flat-jet cap 11 is fastened preferably by means of a union nut 12 which is screwed onto a thread 13 of the nozzle body.

The flat-jet cap 11 is provided with a central bore 15 which, according to FIG. 2, may have a shape coordinated with a liquid insert 16, for example a conical configuration, and which receives the liquid insert 16. A mouth attachment, designated by 17, of the liquid insert 16 lies within a central orifice 18 of the flat-jet cap 11, the mouth attachment 17 according to FIGS. 2 and 3 being capable of projecting with respect to the flat-jet cap 11. The central orifice 18 of the flat-jet cap 11 defines an annular gap 20 which surrounds the mouth attachment 17 and through which air emerges and which causes the atomization of the liquid material, for example colorant, emerging from the mouth attachment 17.

The flat-jet cap 11 has, furthermore, an essentially planar or straight surface portion 21 (without horns) which is perpendicular to the nozzle axis and which, according to FIG. 2, runs over the entire width of the flat-jet cap 11. Surfaces 22, 23 adjoin the surface portion 21 laterally, as is evident from FIG. 3. The transition between the surface portion 21 and the surfaces 22, 23 has a rounded-off configuration, i.e. without edges being formed, as may be gathered from FIGS. 3 and 4.

Located in the surface portion 21, laterally in relation to the central orifice 18, are outlet orifices 24, 25 which in each case communicate with bores 26, 27 running at an inclination with respect to the nozzle axis. These bores 26, 27 are provided at an angle of preferably 45° to the nozzle axis and bring about a flattening of the spray cone in the direction of a flat jet. The spray cone is obtained by virtue of the emergence of the liquid from the mouth attachment 17 and of the air flow emerging through the annular gap 20. The distance between the orifice 24 or 25 and the nozzle axis 14 is preferably 6.5 mm.

The air outlet orifices 24, 25 are arranged at a relatively close distance from the central orifice 18 in relation to the known external mixing nozzle according to FIG. 1. The arrangement of the air outlet orifices 24, 25 are relatively close to the central orifice 18, on the one hand, and also the smooth transition from the surface portion 21 to the oblique surfaces 22, 23 prevent, as far as possible, a deposit of colorant on the flat-jet cap according to the present invention. In a preferred embodiment, the oblique surfaces 22, 23 are at an angle of about 55° to the nozzle axis, this being expedient for flow-directed air routing, i.e., during the coating operation, a back flow can be routed past the nozzle, specifically in such a streamlined manner that the deposit of a colorant coating on the nozzle cap or flat-jet cap 11 is, in practice, largely prevented. It is also essential, in the present invention, that the configuration of the flat-jet cap contains no edges, with the result that the deposit of colorants is also counteracted.

As may further be gathered from FIGS. 2 and 3, a nozzle needle 27, the tip of which extends into the mouth attachment 17, is located centrally in the nozzle body 10 and centrally in the liquid insert 16 in a way known per se.

The nozzle axis is designated by 14 in FIGS. 2 and 3.

The bores 26, 27 are connected to ducts or bores 31, 32 which run parallel to the axis 14 and which are connected to corresponding supply ducts on the nozzle body 10 and serve for the supply of air.

It is clear from FIGS. 2 and 3 that a liquid, such as a colorant, emerges via the liquid insert 11 and the mouth attachment 17 into the drum, which is not illustrated in the drawings, and, at the same time, an airflow for reacting upon and for controlling the colorant jet is blown out via the annular gap 20 and via the outlet orifices 24, 25.

As may be gathered from FIGS. 2–4, the flat-jet cap 11 consists essentially of a cylindrical body which on its end face runs through the planar surface portion 21 running perpendicularly to the nozzle axis and which, furthermore, is defined by oblique surfaces 22, 23 which, widening trapezoidally in the direction of the union nut 12, run from the strip-shaped surface portion 21 symmetrically to the nozzle axis.

The external mixing nozzle according to the invention has, furthermore, the advantage that, due to the short distances between the air outlet orifices 24 and 25, on the one hand, and from the central orifice 18, on the other hand, the forming forces resulting from the emergence of air out of this orifice have a high effect on the colorant jet which emerges from the mouth attachment 17 of the liquid insert 16, this effect being substantially greater than in an external mixing nozzle with a flat-jet cap according to FIG. 1.

According to a preferred embodiment, the optimum atomization quality of the external mixing nozzle according to the invention is achieved when the bores 26, 27 have a diameter of 2.0 mm and the central orifice 18 has a diameter of about 4.2 mm. Such optimization ensures at least the same atomization quality as in an external mixing nozzle with a flat-jet cap according to FIG. 1.

By means of the external mixing nozzle according to the invention, in particular, lacquers, such as cellulose lacquers and Eudragite, are atomized.

The invention claimed is:

1. An external mixing nozzle, for use in coating pharmaceutical products with liquid material like a colorant, with a flat-jet cap which is fastened to a nozzle body, the flat-jet cap being provided with a central bore, pointing towards the nozzle body, for receiving a liquid guiding insert, and having a central orifice which receives a mouth attachment of the liquid insert, at the same time defining an annular gap surrounding the mouth attachment, the flat-jet cap defining a planar surface portion which runs perpendicularly to the axis of the nozzle body and over an entire width of the flat-jet cap and within which the central orifice is provided, and, furthermore, the planar surface portion having adjoining it laterally two surfaces running essentially mirror-symmetrically and obliquely to the axis of the nozzle body and adjoining the planar surface portion, wherein the flat-jet cap contains, in the region of the planar surface portion, outlet orifices which are provided at an equal distance from the central orifice and which communicate with bores provided so as to run in the flat-jet cap obliquely to the axis of the nozzle body, the transitions from the planar surface portion to the lateral surfaces being defined by smooth transitions or roundings such that an airflow for reacting upon and for controlling a liquid material jet emerging from said liquid guiding insert is blown out via the annular gap and via the outlet orifices.

2. The external mixing nozzle as claimed in claim 1, wherein the outlet orifices are provided mirror-symmetrically to the axis of the nozzle body.

3. The external mixing nozzle as claimed in claim 1, wherein the distance between the central orifice and the outlet orifices is about 6.5 mm.

4. The external mixing nozzle as claimed in claim 1, wherein the mouth attachment of the liquid guiding insert projects with respect to the surface portion.

5. The external mixing nozzle as claimed in claim 1, wherein said surfaces run at an angle of about 55° to the axis of the nozzle.

6. The external mixing nozzle as claimed in claim 1, wherein said central orifice has a diameter of about 4.2 mm.

7. The external mixing nozzle as claimed in claim 1, wherein said oblique bores have a diameter of about 2.0 mm.

8. An external mixing nozzle for use in coating pharmaceutical products with liquid material like a colorant, comprising:

a nozzle body having an axis;

a flat-jet cap which is fastened to the nozzle body, the flat-jet cap being provided with a central bore, pointing towards the nozzle body, for receiving a liquid guiding insert, and having a central orifice which receives a mouth attachment of the liquid guiding insert and defining an annular gap surrounding the mouth attachment, wherein the annular gap is provided for emerging air, causing atomization of the liquid material, said liquid material emerging via said liquid guiding insert and the mouth attachment, the flat-jet cap defining a planar surface portion which runs perpendicularly to the axis of the nozzle body and over an entire width of the flat-jet cap and within which the central orifice is provided, the planar surface portion having adjoining it laterally two surfaces running essentially mirror-symmetrically and obliquely to the axis of the nozzle body, wherein the flat-jet cap contains, in the region of the planar surface portion, outlet orifices which are provided at an equal distance from the central orifice and which communicate with bores provided so as to run in the flat-jet cap obliquely to the axis of the nozzle body, the transitions from the planar surface portion to the lateral surfaces being defined by smooth transitions or roundings such that an airflow for reacting upon and for controlling the liquid material jet is blown out via the annular gap and via the outlet orifices.

9. An external mixing nozzle for use in coating pharmaceutical products with liquid material, comprising:

a nozzle body having an axis;

a flat-jet cap which is fastened to the nozzle body, the flat-jet cap being provided with a central bore or the like, pointing towards the nozzle body, for receiving a liquid guiding insert, and having a central orifice which receives a mouth attachment of the liquid guiding insert, at the same time defining an annular gap surrounding the mouth attachment, wherein the annular gap is provided for emerging air, which is supplied by air slots on the liquid insert, wherein the bores are connected to ducts which are connected to corresponding supply ducts on the nozzle body for supplying air causing atomization of the liquid material, said liquid material emerging via said liquid guiding insert and the mouth attachment, the flat-jet cap defining a planar surface portion which runs perpendicularly to the axis of the nozzle body and over the entire width of the flat-jet cap and within which the central orifice is provided, and, furthermore, the planar surface portion having adjoining it laterally two surfaces running essentially mirror-symmetrically and obliquely to the axis of the nozzle body and adjoining the planar surface portion, wherein the flat-jet cap contains, in the region of the planar surface portion, outlet orifices which are provided at an equal distance from the central orifice and which communicate with bores provided so as to run in the flat-jet cap obliquely to the axis of the nozzle body, the transitions from the planar surface portion to the lateral surfaces being defined by smooth transitions or roundings such that an airflow for reacting upon and for controlling the liquid material jet is blown out via the annular gap and via the outlet orifices.

10. An external mixing nozzle, adapted to be coupled to a source of liquid and airflow, for combining a liquid and an airflow and ejecting a liquid spray, comprising:

a nozzle body having an axis;

a flat-jet cap which is coupled to the nozzle body, and over an entire width of the flat-jet cap the flat-jet cap having a central bore pointing towards the nozzle body, for receiving a liquid guiding insert having a mouth attachment, and having a central orifice, which receives the mouth attachment and defines an annular gap surrounding the mouth attachment, the flat-jet cap also defining a planar surface portion which runs perpendicularly to the axis of the nozzle body and within which the central orifice is provided, the planar surface portion having adjoining laterally thereto two surfaces running essentially mirror-symmetrically and obliquely to the axis of the nozzle body, wherein the flat-jet cap contains, in the region of the planar surface portion, outlet orifices which are provided at an equal distance from the central orifice and which communicate with bores provided so as to run within the flat-jet cap obliquely to the axis of the nozzle body, and, wherein transitions from the planar surface portion to the lateral surfaces are defined by smooth roundings such that an airflow for reacting upon and for controlling the liquid material jet emerging from said liquid guiding insert is blown out via the annular gap and via the outlet orifices.

* * * * *